US012442102B2

(12) United States Patent
Takahashi et al.

(10) Patent No.: US 12,442,102 B2
(45) Date of Patent: Oct. 14, 2025

(54) APPARATUS FOR PLATING AND METHOD OF PLATING

(71) Applicant: EBARA CORPORATION, Tokyo (JP)

(72) Inventors: Naoto Takahashi, Tokyo (JP); Naoki Shimomura, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/923,570

(22) PCT Filed: Jun. 18, 2021

(86) PCT No.: PCT/JP2021/023193
§ 371 (c)(1),
(2) Date: Nov. 4, 2022

(87) PCT Pub. No.: WO2022/264402
PCT Pub. Date: Dec. 22, 2022

(65) Prior Publication Data
US 2025/0075362 A1 Mar. 6, 2025

(51) Int. Cl.
*C25D 17/00* (2006.01)
*C25D 5/02* (2006.01)
*C25D 7/12* (2006.01)
*C25D 17/12* (2006.01)

(52) U.S. Cl.
CPC ..... *C25D 17/001* (2013.01); *C25D 5/022* (2013.01); *C25D 7/12* (2013.01); *C25D 17/002* (2013.01); *C25D 17/008* (2013.01); *C25D 17/12* (2013.01)

(58) Field of Classification Search
None
See application file for complete search history.

(56) References Cited

U.S. PATENT DOCUMENTS 4,828,654 A * 5/1989 Reed ..... C25D 17/12 205/97
6,261,433 B1 * 7/2001 Landau ..... C25D 17/001 204/260
2006/0243598 A1 * 11/2006 Singh ..... C25D 17/001 257/E21.175
2010/0044236 A1 * 2/2010 Mayer ..... C25F 3/30 204/252
2014/0144781 A1 5/2014 He
2016/0145760 A1 * 5/2016 Fujikata ..... C25D 17/10 205/128

(Continued)

FOREIGN PATENT DOCUMENTS

CN 109137051 A 1/2019
JP 2016211010 A * 12/2016

(Continued)

*Primary Examiner* — Louis J Rufo
(74) *Attorney, Agent, or Firm* — BakerHostetler

(57) ABSTRACT

There is provided an apparatus for plating a substrate, comprising: an anode placed to be opposed to the substrate; and an intermediate mask placed between the substrate and the anode to be arranged on a substrate side, provided with a first center opening that causes an electric field from the anode toward the substrate to pass through, and further provided with an auxiliary anode that is placed in an internal space of the intermediate mask to be arranged around the first center opening, wherein the auxiliary anode has an area that is not greater than ⅕ of an area of the anode.

14 Claims, 8 Drawing Sheets

(56) References Cited

U.S. PATENT DOCUMENTS

| | | | |
|---|---|---|---|
| 2017/0370017 | A1 | 12/2017 | Keigler et al. |
| 2019/0256997 | A1 | 8/2019 | Shamoto et al. |
| 2021/0010147 | A1 | 1/2021 | Takahashi |

FOREIGN PATENT DOCUMENTS

| | | | |
|---|---|---|---|
| JP | 6427316 | B2 | 11/2018 |
| JP | 2019-056164 | A | 4/2019 |
| JP | 2019-143217 | A | 8/2019 |
| KR | 2021-0006845 | A | 1/2021 |

* cited by examiner

APPARATUS FOR PLATING AND METHOD OF PLATING

TECHNICAL FIELD

The present disclosure relates to an apparatus for plating and a method of plating.

BACKGROUND ART

In the case of electroplating a substrate having a seed layer, there is a known phenomenon called terminal effect that the plating film thickness in a center portion of the substrate is smaller than the plating film thickness in an edge portion of the substrate, due to a difference in resistance value of a current route between the center portion of the substrate and the edge portion of the substrate (i.e., a difference in resistance value of the seed layer between the center portion of the substrate and the edge portion of the substrate). A plating apparatus described in Japanese Patent No. 6427316 (Patent Document 1) has been proposed as a plating apparatus that relieves such a terminal effect. In the apparatus described in Patent Document 1, an ionic current collimator (corresponding to an anode mask) including an auxiliary electrode is placed near to an anode. The film thickness distribution of the entire substrate is controlled by making the auxiliary electrode function as an anode or as a cathode according to a sheet resistance of the substrate. The film thickness distribution at an edge portion of the substrate is controlled by a thief sub-electrode (virtual thief cathode) placed around the substrate.

RELATED ART DOCUMENT

Patent Document

Patent Document 1: Japanese Patent No. 6427316
Patent Document 2: Japanese Unexamined Patent Publication No. 2019-56164
Patent Document 3: US Published Patent Application No. 2017-0370017

SUMMARY OF INVENTION

Technical Problem

In the case of plating substrates having different substrate specifications, for example, different resist opening ratios and different sheet resistances of the seed layer (hereinafter may be referred to as seed resistance) (seed film thickness) in an identical plating tank, the different substrate specifications provide different influences of the terminal effect and accordingly have different optimum opening dimensions of a mask (an intermediate mask and an anode mask). It is thus required to change the dimensions of the opening of the mask, in order to achieve the good surface leveling (in-plane uniformity of the plating film thickness). Individually setting respective plating cells in the plating tank according to the substrate specifications, however, reduces the number of plating cells usable for simultaneous plating and reduces the throughput.

An apparatus for plating wafers may be provided with a mechanical configuration (mechanical mechanism) to mechanically change the openings of the intermediate mask and the anode mask. The intermediate mask is, however, placed at a position near to the substrate and a stirring paddle, so that there is only a limited space for placing the mechanical mechanism. Especially in a plating apparatus for rectangular substrates that have larger dimensions than the dimensions of the wafers it is difficult to mount the mechanical mechanism. Furthermore, since the intermediate mask is placed at a position near to the substrate, the mechanical mechanism is required to have high dimensional accuracy and high precision and thereby has high technical hurdles.

In the configuration of the apparatus described in Patent Document 1, the thief sub-electrode is placed on a side wall of the plating tank surrounding the substrate. This configuration is, however, not employable in a plating apparatus that plates vertically standing substrates. Furthermore, the auxiliary electrode provided in the ionic current collimator is placed on an anode side further from the substrate. It is accordingly difficult to effectively regulate the plating current at the edge portion of the substrate. Additionally, since the auxiliary electrode is placed on the anode side further from the substrate, the flow of large electric current is required for adjustment of the electric field. With a view to suppressing the current density, the auxiliary electrode is required to have a large area of above a certain level.

One object of the present disclosure is to provide a configuration that controls plating current according to the specification of a substrate, while reducing an influence of dimensional limitation.

Solution to Problem

According to one aspect, there is provided an apparatus for plating a substrate, comprising: an anode placed to be opposed to the substrate; and an intermediate mask placed between the substrate and the anode to be arranged on a substrate side, provided with a first center opening that causes an electric field from the anode toward the substrate to pass through, and further provided with an auxiliary anode that is placed in an internal space of the intermediate mask to be arranged around the first center opening, wherein the auxiliary anode has an area that is not greater than ⅕ of an area of the anode.

DESCRIPTION OF EMBODIMENTS

Figure 1:
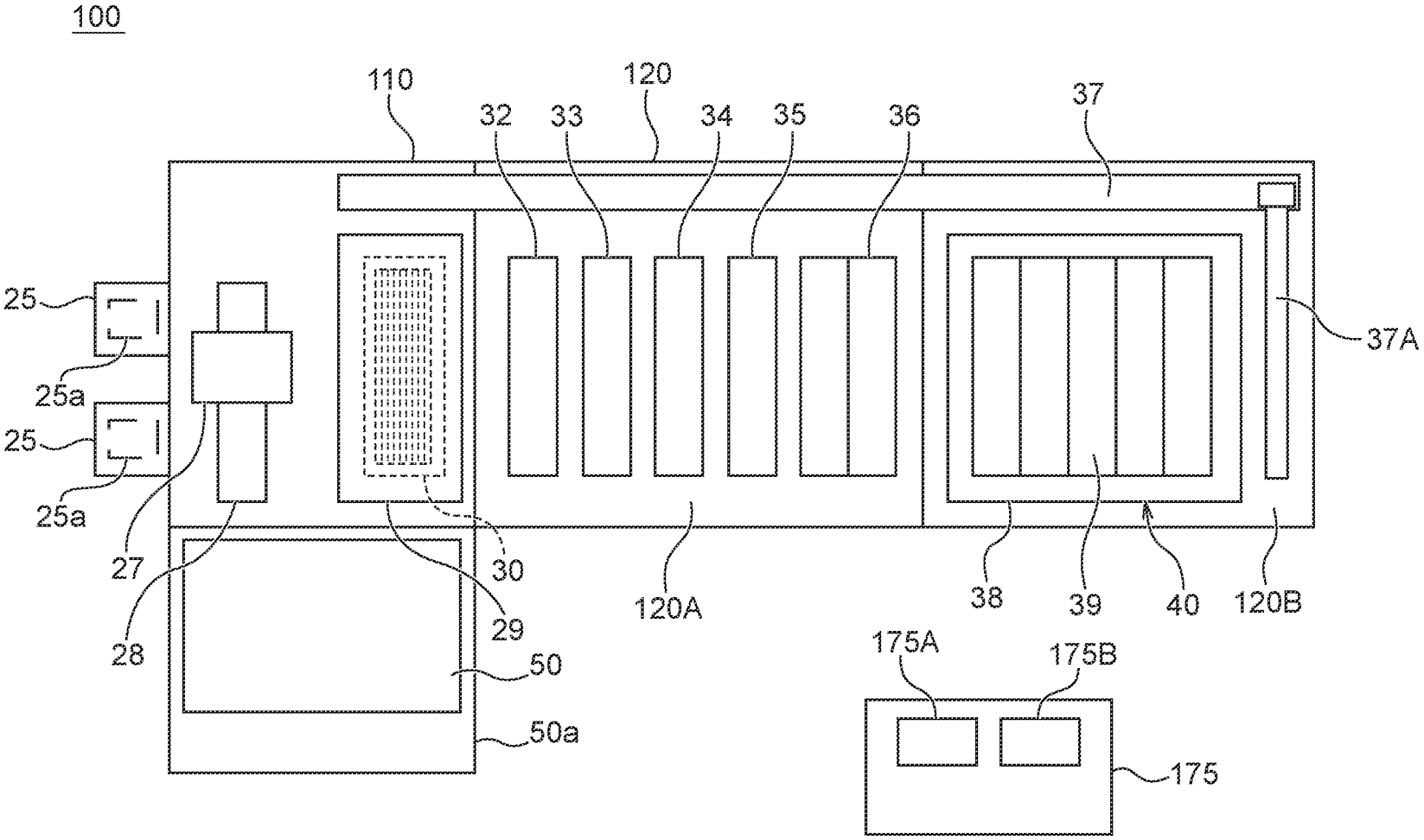
FIG. 1 is an overall arrangement drawing illustrating a plating apparatus according to one embodiment.

The following describes embodiments of the present disclosure with reference to drawings. In the drawings attached, identical or similar elements are expressed by identical or similar reference signs. In the description of the respective embodiments, duplicated description on the identical or similar elements may be omitted. The features and the characteristics shown in each of the embodiment are also applicable to the other embodiments unless they are contradictory to each other.

In the description hereof, a term "substrate" includes not only semiconductor substrates, glass substrates, liquid crystal substrates and printed circuit boards but magnetic recording media, magnetic recording sensors, mirrors, optical elements, micromachine elements, partially fabricated integrated circuits, and any other objects to be processed. The "substrate" includes those having any arbitrary shapes, such as a polygonal shape and a circular shape. In the description hereof, the expressions such as "front face", "rear face", "front", "back", "upper" or "upward", "lower" or "downward", "left" or "leftward", and "right" or "rightward" are used. These expressions indicate the positions, the orientations, and the directions on the sheet surface of the illustrated drawings for the purpose of explanation, and these positions, orientations and directions may be different from those in the actual arrangement, for example, when using the apparatus.

First Embodiment

FIG. 1 is an overall arrangement drawing illustrating a plating apparatus according to one embodiment. The plating apparatus 100 is configured to plate a substrate in such a state that the substrate is held by a substrate holder 11 (shown in FIG. 2). The plating apparatus 100 is roughly divided into a loading/unloading station 110 configured to load the substrate to the substrate holder 11 or unload the substrate from the substrate holder 11: a processing station 120 configured to process the substrate; and a cleaning station 50*a*. The processing station 120 includes a preprocess and postprocess station 120A configured to perform a preprocess and a postprocess of the substrate and a plating station 120B configured to perform a plating process of the substrate.

The loading/unloading station 110 includes one or a plurality of cassette tables 25 and a substrate mounting/demounting module 29. The cassette table 25 allows a cassette 25*a* with a substrate placed therein to be mounted thereon. The substrate mounting/demounting module 29 is configured to mount the substrate to the substrate holder 11 and demount the substrate from the substrate holder 11. A stocker 30 configured to place the substrate holder 11 therein is provided in the vicinity of (for example, below) the substrate mounting/demounting module 29. The cleaning station 50*a* has a cleaning module 50 configured to clean the substrate after the plating process and dry the cleaned substrate. The cleaning module 50 is, for example, a spin rinse dryer.

A transfer robot 27 is placed at a location surrounded by the cassette tables 25, the substrate mounting/demounting module 29 and the cleaning station 50*a* to transfer the substrate between these units. The transfer robot 27 is configured to be travelable by a traveling mechanism 28. The transfer robot 27 is configured, for example, to take out a substrate before plating from the cassette 25*a* and transfer the substrate before plating to the substrate mounting/demounting module 29, to receive a substrate after plating from the substrate mounting/demounting module 29, to transfer the substrate after plating to the cleaning module 50, and to take out a cleaned and dried substrate from the cleaning module 50 and place the cleaned and dried substrate into the cassette 25*a*.

The preprocess and postprocess station 120A includes a pre-wet module 32, a pre-soak module 33, a first rinse module 34, a blow module 35 and a second rinse module 36. The pre-wet module 32 wets a surface to be plated or a plating surface of the substrate before the plating process with a process liquid, such as pure water or deaerated water, so as to replace the air inside a pattern formed on the surface of the substrate with the process liquid. The pre-wet module 32 is configured to perform a pre-wet process that replaces the process liquid inside the pattern with a plating solution during plating and thereby facilitates supplying the plating solution to the inside of the pattern. The pre-soak module 33 is configured to perform a pre-soak process that removes an oxidized film of a large electrical resistance present on, for example, the surface of a seed layer formed on the plating surface of the substrate before the plating process by etching using a process liquid, such as sulfuric acid or hydrochloric acid, and cleans or activates the surface of a plating base layer. The first rinse module 34 cleans the substrate after the pre-soak process along with the substrate holder 11 by using a cleaning solution (for example, pure water). The blow module 35 drains the liquid from the substrate after cleaning. The second rinse module 36 cleans the substrate after plating along with the substrate holder 11 by using a cleaning solution. The pre-wet module 32, the pre-soak module 33, the first rinse module 34, the blow module 35 and the second rinse module 36 are placed in this sequence. This configuration is only an example, and the preprocess and postprocess station 120A is not limited to the configuration described above but may adopt another configuration.

The plating station 120B includes a plating module 40 that has a plating tank 39 and an overflow tank 38. The plating tank 39 is divided into a plurality of plating cells. Each of the plating cells has one substrate placed inside thereof and soaks the substrate in a plating solution kept inside thereof, so as to plate the surface of the substrate, for example, by copper plating. The type of the plating solution is not specifically limited, but various plating solutions may be used according to their uses and applications. This configuration of the plating station 120B is only one example, and the plating station 120B may adopt another configuration.

The plating apparatus 100 also includes a transfer device 37 that employs, for example, a linear motor system and that is located on a lateral side of these respective devices described above to transfer the substrate holder 11 along with the substrate between these devices. This transfer device 37 has one or a plurality of transporters and is configured to transfer the substrate holder 11 between the substrate mounting/demounting module 29, the stocker 30, the pre-wet module 32, the pre-soak module 33, the first rinse module 34, the blow module 35, the second rinse module 36, and the plating module 40 by the one or plurality of transporters.

The plating apparatus 100 configured as described above has a control module (controller) 175 serving as a control portion configured to control the respective portions described above. The controller 175 includes a memory 175B configured to store predetermined programs therein and a CPU 175A configured to perform the programs stored in the memory 175B. A storage medium that configures the memory 175B stores a variety of set data and various programs including programs of controlling the plating apparatus 100. The programs include, for example, programs of performing transfer control of the transfer robot 27, mounting and demounting control of the substrate to and from the substrate holder 11 in the substrate mounting/demounting module 29, transfer control of the transfer device 37, controls of the processings in the respective processing modules, control of the plating process in the plating module 40, and control of the cleaning station 50*a*. The storage medium may include a non-volatile storage medium and/or a volatile storage medium. The storage medium used herein may be any of computer readable known storage media, for example, memories such as ROMs, RAMs, flash memories and disk-shaped storage media such as hard disks, CD-ROMs, DVD-ROMs and flexible disks.

The controller 175 is configured to make communication with a non-illustrated upper-level controller that comprehensively controls the plating apparatus 100 and other relevant apparatuses and to exchange data with a database included in the upper level controller. Part or the entirety of the functions of the controller 175 may be configured by hardware, such as an ASIC. Part or the entirety of the functions of the controller 175 may also be configured by a sequencer. Part or the entirety of the controller 175 may be placed inside and/or outside of the housing of the plating apparatus 100. Part or the entirety of the controller 175 is connected to make communication with the respective portions of the plating apparatus 100 by wire and/or wirelessly.

(Plating Module)

Figure 2:
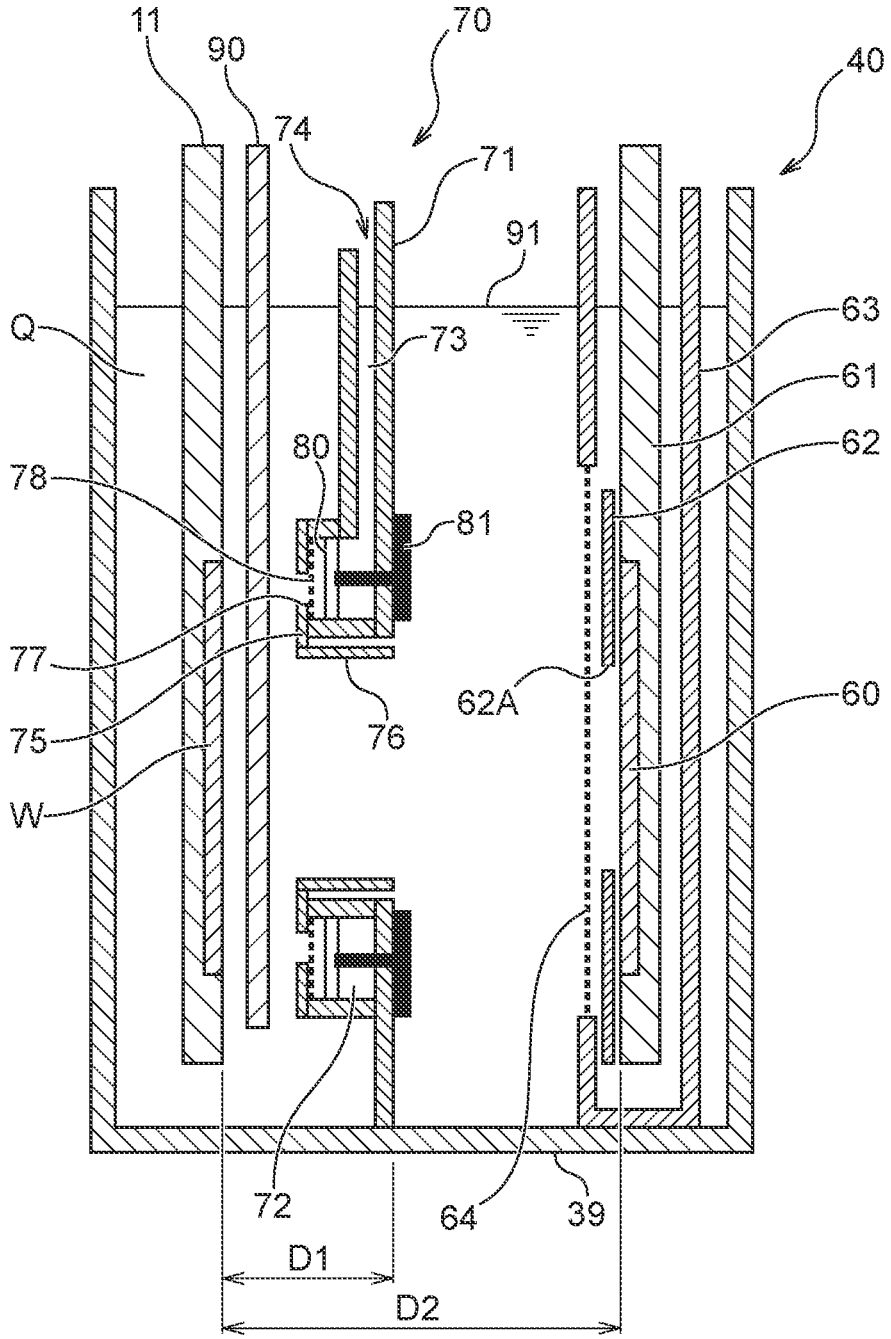
FIG. 2 is a schematic diagram illustrating a plating module.

FIG. 2 is a schematic diagram illustrating the plating module 40. This drawing illustrates one plating cell of the plating tank 39 with omission of the overflow tank 38. In the description below, one plating cell of the plating tank 39 may be referred to as the plating cell 39. The plating apparatus 100 according to the embodiment is an electroplating apparatus configured to plate a surface of a substrate W with a metal by supplying electric current to a plating solution Q. The plating module 40 includes a plating tank 39 configured to store a plating solution inside thereof, an anode (main anode) 60 placed to be opposed to a substrate W held by the substrate holder 11 in the plating tank 39, and an intermediate mask 70 configured to regulate an electric field from the anode 60 toward the substrate W and thereby adjust a potential distribution on the substrate W. The substrate holder 11 is configured to hold the substrate W in a polygonal shape (for example, in a rectangular shape) in such a manner as to be attachable to and detachable from and to soak the substrate W in the plating solution Q in the planting tank 39. According to another embodiment, however, a substrate (wafer) in a circular shape may be used. The anode 60 and the substrate W are arranged to be extended in a vertical direction and to be opposed to each other in the plating solution. The anode 60 is connected with a positive electrode of a power source (not shown) via an anode holder 61 provided to hold the anode 60, whereas the substrate W is connected with a negative electrode of the power source via the substrate holder 11. When a voltage is applied between the anode 60 and the substrate W, electric current flows in the substrate W to form a metal film on the surface of the substrate W in the presence of the plating solution.

The anode 60 used herein is an insoluble anode that is not dissolved in the plating solution and that is made of, for example, iridium oxide or platinum-coated titanium. A soluble anode may, however, be used for the anode 60. An available example of the soluble anode is a soluble anode made of a phosphorus-containing copper in the case of copper plating. The substrate W is, for example, a semiconductor substrate, a glass substrate, a resin substrate or any other object to be processed. The metal used for plating the surface of the substrate W is, for example, copper (Cu), nickel (Ni), tin (Sn), Sn—Ag alloy or cobalt (Co). The plating solution Q is an acidic solution containing the metal used for plating. For example, in the case of copper plating, the plating solution Q is a copper sulfate solution.

The anode holder 61 is provided with an anode mask 62 configured to change the dimensions of an opening 62A and to adjust an exposed area of the anode 60 (an effective area that provides an electric field (electric current) from the anode toward the substrate). In the description below, the anode mask 62 may be referred to as variable anode mask (VAM) 62 or VAM 62. For example, the anode mask 62 may be configured to move respective mask pieces placed on an upper side, a lower side, a left side and a right side, upward, downward, leftward or rightward and thereby change the dimensions of the opening or may be configured to relatively move a plurality of frame bodies having openings, in oblique directions and thereby change the dimensions of the opening defined by overlap of the plurality of frame bodies. This type of variable anode mask is described in, for example, Japanese Unexamined Patent Publication No. 2019-56164 (Patent Document 2). A split anode (multizone anode) consisting of a plurality of divisional anode pieces may be used, instead of the variable anode mask 62. The effective area of the anode may be adjusted or the electric field (electric current) from the anode toward the substrate may be adjusted by selecting an anode piece (anode pieces) which the electric current is to flow in or by regulating the electric current flowing in each of the anode pieces. This type of variable anode mask is described in, for example, the specification of US Published Patent Application No. 2017-0370017 (Patent Document 3).

The anode holder 61 is placed in an anode box 63. The anode box 63 has an opening that is provided at a position opposed to the anode 60 and that is covered with a diaphragm 64. In the case where an additive component included in the plating solution is oxidized by an electrochemical reaction on the surface of the insoluble anode to generate a harmful decomposition product that is harmful to the plating performance, the diaphragm 64 serves to suppress the harmful decomposition product from reaching the surface of the substrate. The diaphragm 64 does not interfere with the electric field (electric current) from the anode 60 toward the substrate W.

The plating module 40 further includes a paddle 90 configured to stir the plating solution. The paddle 90 is placed in the vicinity of the surface of the substrate W that is held by the substrate holder 11 in the plating tank 39. The paddle 90 is made of, for example, titanium (Ti) or a resin. The paddle 90 moves back and forth in parallel to the surface of the substrate W to stir the plating solution Q, so as to uniformly supply a sufficient amount of metal ion to the surface of the substrate W during plating. As shown in FIG. 2, the intermediate mask 70 is placed between the substrate W and the anode 60 to be arranged at a position nearer to the substrate W and has a center opening 76 configured to limit the electric field in the plating solution.

Figure 3:
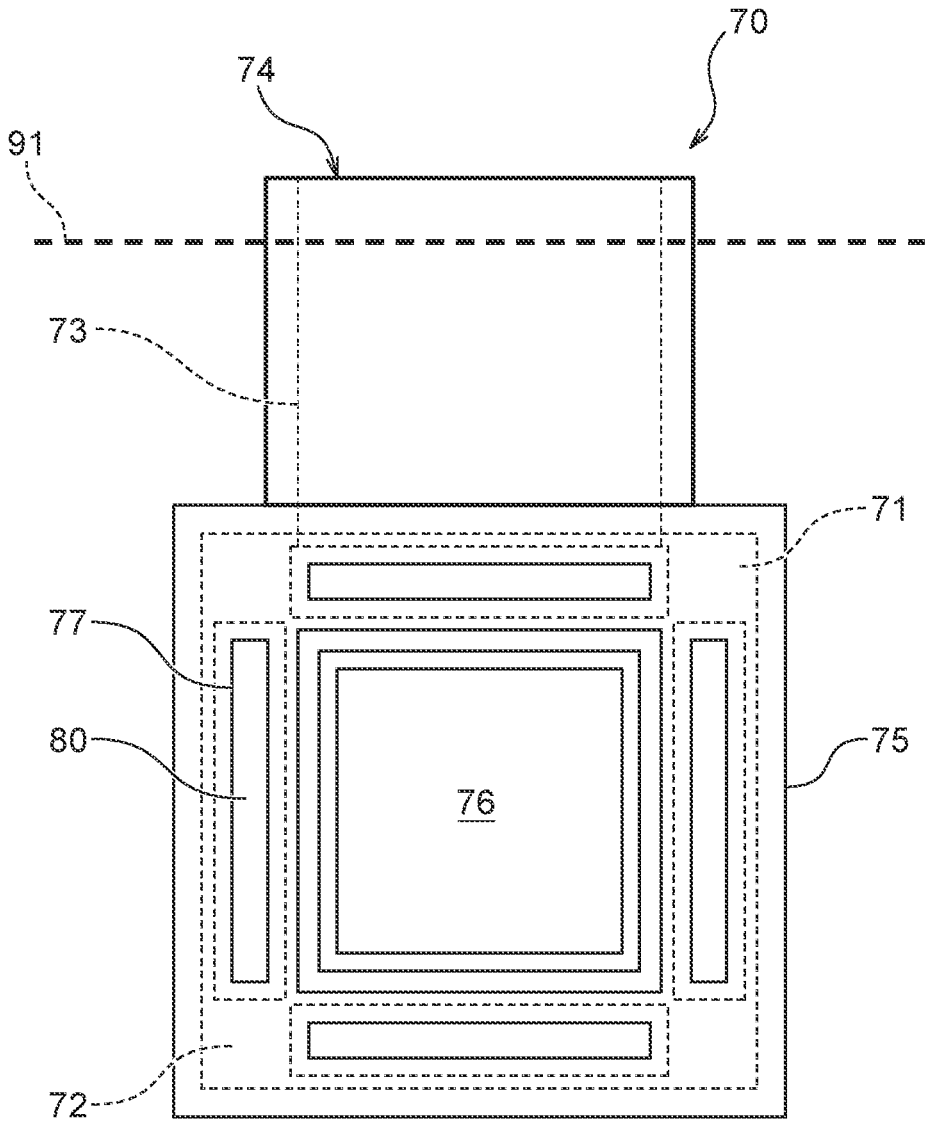
FIG. 3 is a schematic diagram illustrating an intermediate mask according to a first embodiment viewed from a substrate side.

FIG. 3 is a schematic view illustrating the intermediate mask according to the first embodiment viewed from a substrate side. As shown in FIG. 2 and FIG. 3, the intermediate mask 70 includes a mask main body 71, an auxiliary anode 80 placed in an internal space 72 of the mask main body 71, and a shielding plate 75 attached to a front face of the mask main body 71. The mask main body 71 and the shielding plate 75 are made of a material that has resistance to the plating solution and that shields the electric field (electric current). The mask main body 71 has an opening corresponding to the center opening 76, is in an approximately rectangular shape in planar view, and has the internal space 72 which the auxiliary anode 80 is placed in. The mask main body 71 also has an opening from which the auxiliary anode 80 is exposed on the substrate W-side. The shielding plate 75 is attached to the mask main body 71, such that an opening 77 of the shielding plate 75 overlaps with the opening of the mask main body 71. A diaphragm 78 is attached to the opening 77 of the shielding plate 75, such that the auxiliary anode 80 is exposed via the diaphragm 78. The mask main body 71 is also provided with an exhaust passage 73 that communicates with the internal space 72. An upper end of the exhaust passage 73 forms an exhaust port 74 that is open above a liquid level 91 of the plating solution. According to the embodiment, the exhaust passage 73 and the exhaust port 74 configure an air vent hole.

The auxiliary anode 80 is electrically connected with a bus bar 81 and is connected with a positive electrode of a power source (not shown) via the bus bar 81. The auxiliary anode 80 is configured to serve as a supplementary anode that receives a positive bias applied from the power source and that supplies an electric field (electric current) to the substrate W. The auxiliary anode 80 is made of an insoluble anode material. The exhaust passage 73 serves to discharge oxygen generated by an electrode reaction at the auxiliary anode 80 to outside of the tank. This suppresses bubbles of oxygen from being accumulated around the auxiliary anode 80 and from interfering with the electric field (electric current) from the auxiliary anode 80 toward the substrate W. The exhaust passage 73 may be omitted in the case where the auxiliary anode 80 is made of a soluble anode material.

According to the embodiment, the auxiliary anode 80 is provided along respective sides of the center opening 76 but is not provided at positions corresponding to corners of the center opening 76. This configuration suppresses the electric field (electric current) from being concentrated at the corners of the substrate W to make the film thickness at the corners non-uniform. According to another specification of the substrate, the auxiliary anode may also be provided at the corners of the center opening 76. In this case, the auxiliary anode may be provided as an integral ring-shaped member.

The auxiliary anode 80 is provided in the intermediate mask 70 that is placed in the vicinity of the substrate W, with a view to uniformizing a plating film thickness distribution in the vicinity of the edges of the substrate. The area of the auxiliary anode 80 is accordingly smaller than the area of auxiliary anode in a configuration that the auxiliary anode is placed on an anode 60-side. In one example, the total area of the auxiliary anode 80 is not greater than ⅕ of the area of the anode. As shown in FIG. 2, when a distance between the intermediate mask 70 and the substrate W is expressed as D1 and a distance between the anode 60 and the substrate W is expressed as D2, in one example, the distance D1 between the intermediate mask 70 and the substrate W is not less than ¼ and not greater than ⅓ of the distance D2 between the anode 60 and the substrate W. The distance D1 between the intermediate mask 70 and the substrate W is a distance between an anode-side face of the intermediate mask 70 and a plating surface or a surface to be plated of the substrate W. The distance D2 between the anode 60 and the substrate W is a distance between a substrate-side face of the anode 60 and the plating surface or the surface to be plated of the substrate W. It should be noted that FIG. 2 is a schematic view for the purpose of description of the configuration and may not necessarily reflect the actual dimensions.

The shielding plate 75 is attached to the front face of the mask main body 71. The shielding plate 75 has the center opening 76 that is smaller than the center opening of the mask main body 71 and is configured, such that the center opening 76 of the shielding plate 75 defines the center opening 76 of the intermediate mask 70. Regulating the dimensions of the center opening 76 of the shielding plate 75 regulates the dimensions of the center opening 76 of the intermediate mask 70 and thereby adjusts the electric field (electric current) from the anode 60 toward the substrate W. As shown in FIG. 2 and FIG. 3, the shielding plate 75 has the opening 77 which the auxiliary anode 80 on each side is exposed on and which is covered with the diaphragm 78. In the case where an additive component included in the plating solution is oxidized by an electrochemical reaction on the surface of the insoluble anode to generate a harmful decomposition product that is harmful to the plating performance, the diaphragm 78 serves to suppress the harmful decomposition product from reaching the surface of the substrate. The diaphragm 78 does not interfere with the electric field (electric current) from the auxiliary anode 80 toward the substrate W. The electric field (electric current) from the auxiliary anode 80 toward the substrate W may be adjusted by regulating the size of the opening 77 of the shielding plate 75.

In this embodiment, the dimensions of the center opening 76 of the intermediate mask 70 (of the shielding plate 75) are selected according to a large terminal effect (low resist aperture ratio and high seed resistance/small seed film thickness). More specifically, the dimensions of the center opening 76 of the shielding plate 75 are restricted, such as to reduce the electric current flowing in the edge portion of the substrate and uniformize the plating film thickness, according to the case of a large terminal effect and a higher increase rate of the electric current flowing in the edge portion of the substrate compared with the electric current flowing in the center portion of the substrate. Regulating the plating current to be supplied from the auxiliary anode 80 to the substrate W (mainly to the edge portion of the substrate) according to the magnitude of the terminal effect of the substrate W (the resist aperture ratio and the seed resistance) has similar effects to the effects by changing (increasing) the dimensions of the opening of the intermediate mask 70 and uniformizes the plating film thickness distribution of the substrate. The auxiliary anode 80 is placed in the vicinity of the edge portion of the substrate. This configuration performs the effective regulation of especially the plating current to the edge portion of the substrate.

In this embodiment, regulating the dimensions of the opening 77 of the shielding plate 75 for the auxiliary anode 80 and/or regulating the dimensions of the center opening 76 of the shielding plate 75 according to the specification range (the resist aperture ratio and the seed film thickness) of the substrate W as the object to be plated allows for fine adjustment of the applicable range of the terminal effect.

A modified configuration may not include the shielding plate 75 but may be provided with a diaphragm at the opening of the mask main body 71 which the auxiliary anode 80 is exposed on. In this configuration, the center opening of the mask main body 71 serves ad the center opening of the intermediate mask 70. Regulating the dimensions of the opening of the mask main body 71 which the auxiliary anode 80 is exposed on and/or regulating the dimensions of the center opening of the mask main body 71 allow for fine adjustment of the applicable range of the terminal effect.

Figure 4:
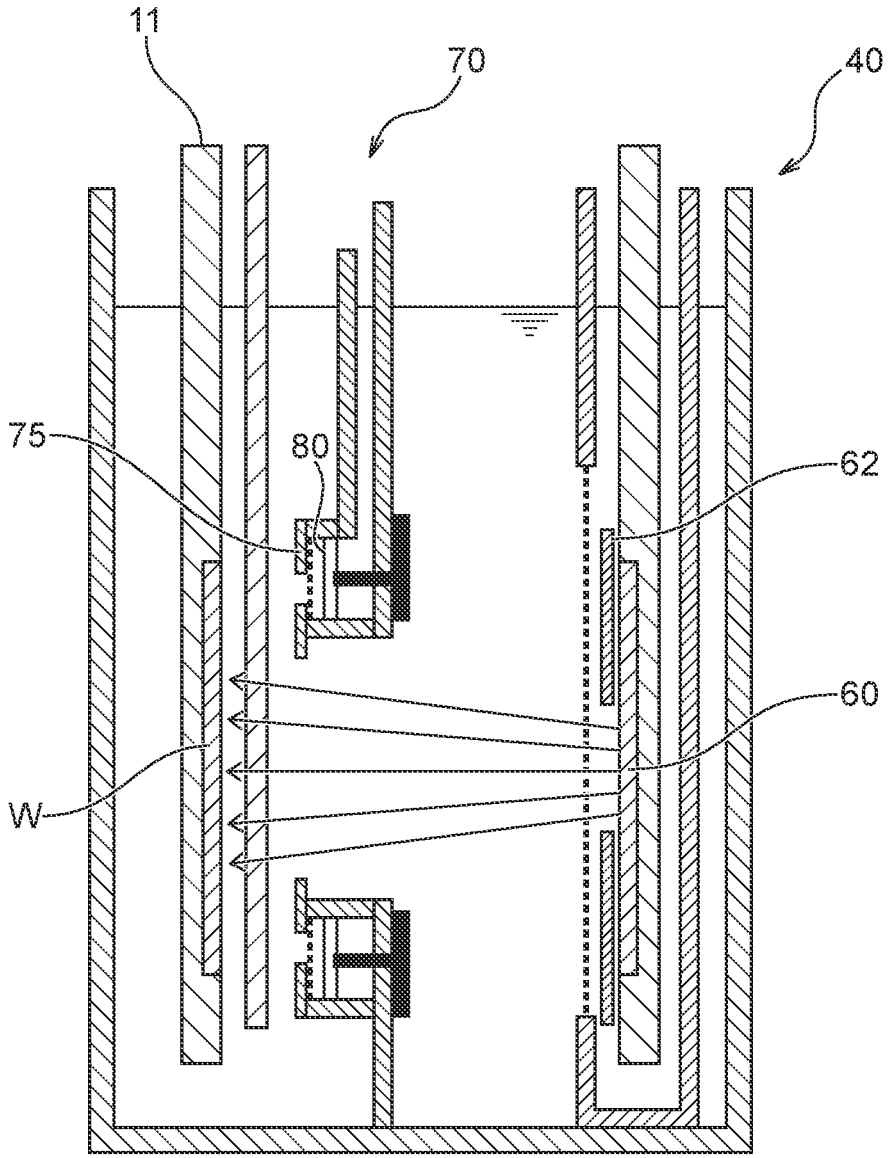
FIG. 4 is an explanatory view illustrating an electric field from an anode toward a substrate in the case of a large terminal effect.
Figure 5:
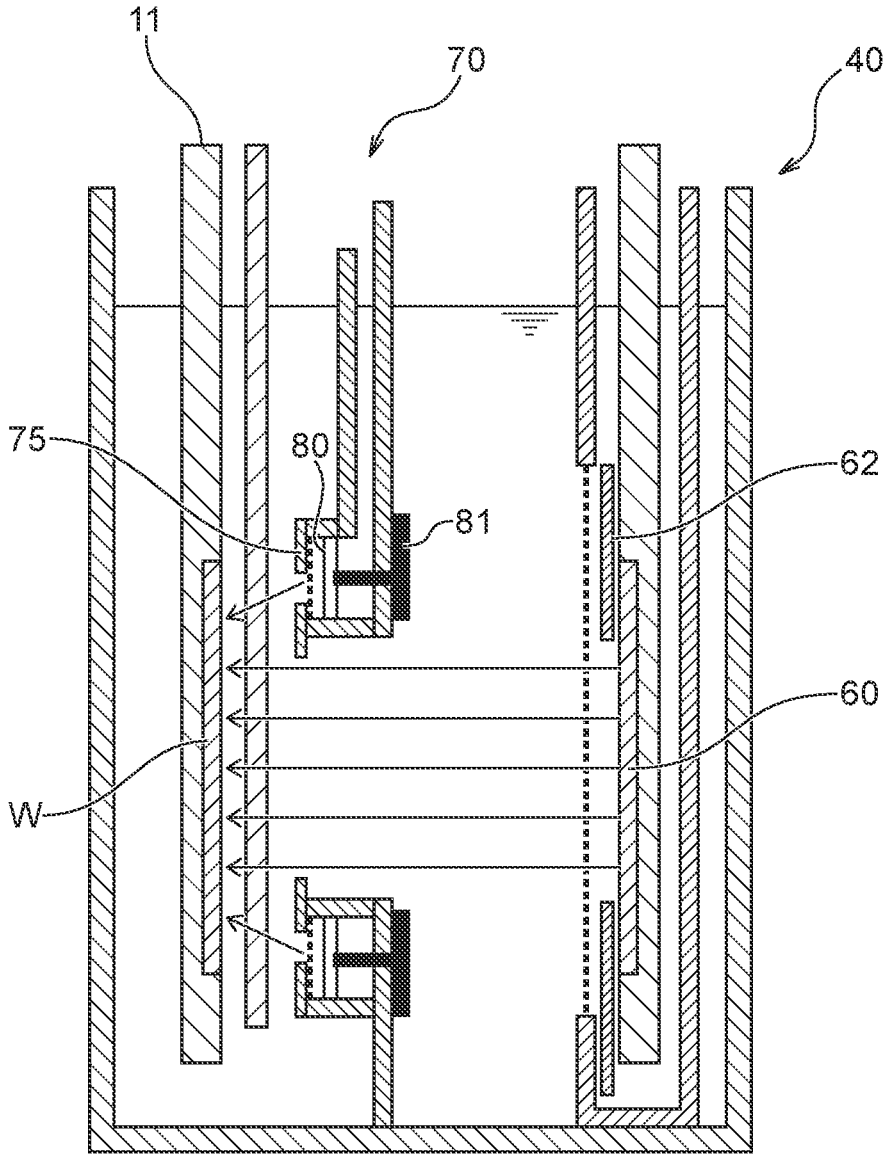
FIG. 5 is an explanatory view illustrating the electric field from the anode toward the substrate in the case of a small terminal effect.
Figure 6:
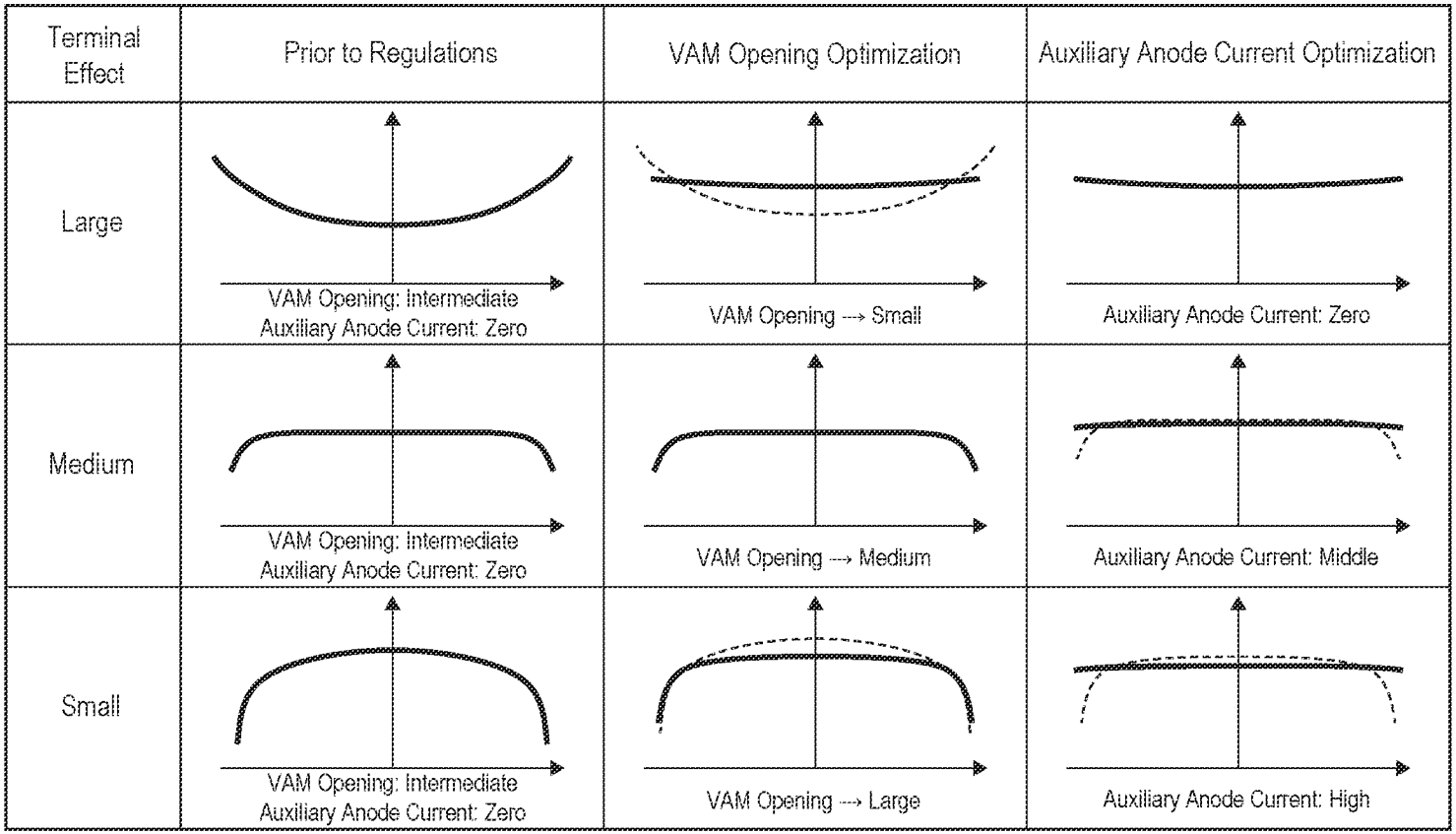
FIG. 6 is an explanatory view illustrating a method of adjusting a plating film thickness distribution.

FIG. 4 is an explanatory diagram illustrating the electric field from the anode 60 toward the substrate W in the case of a large terminal effect (low resist aperture ratio and high seed resistance/small seed film thickness). FIG. 5 is an explanatory diagram illustrating the electric field from the anode 60 toward the substrate W in the case of a small terminal effect (high resist aperture ratio and low seed resistance/large seed film thickness). FIG. 6 is an explanatory view illustrating a method of adjusting the plating film thickness distribution. Part of the shielding plate 75 is omitted from the illustrations of FIG. 4 and FIG. 5. According to the embodiment, the plating film thickness distribution is adjusted by regulating the dimensions of the opening of the variable anode mask (VAM) 62 and regulating the electric current flowing in the auxiliary anode 80. Prior to such regulations, it is assumed that the dimensions of the opening of the variable anode mask 62 are intermediate dimensions (first dimensions) and that the electric current flowing in the auxiliary anode 80 is equal to zero. The graphs in the respective cells in FIG. 6 show plating film thickness distributions of the substrate with the position on the substrate (the linear position passing through the center of the substrate) as abscissa. The origin of the abscissa represents the center of the substrate, and the position farther from the origin represents the position nearer to the edge portion of the substrate. The ordinate of the graphs in the respective cells represents the plating film thickness on the substrate. In the case where the split anode is employed instead of the variable anode mask 62, the control is made to select an anode piece (anode pieces) which the electric current is to flow in or to regulate the electric current flowing in each of the anode pieces, corresponding to the electric field that depends on the dimensions of the opening of the variable anode mask 62.

As shown in the first row in the table of FIG. 6, in the case of the large terminal effect, prior to the regulations of the variable anode mask and the auxiliary anode, the terminal effect has an influence on the plating film thickness distribution: the plating film thickness is smaller in the center portion of the substrate and is larger in the edge portion of the substrate. As shown in FIG. 4, in this state, the dimensions of the opening 62A of the variable anode mask 62 are regulated according to the magnitude of the terminal effect to be second dimensions that are smaller than the intermediate dimensions. This uniformizes the plating film thickness distribution as shown by a solid line curve in the graph of a "VAM opening optimization" cell in the first row of the table of FIG. 6. The electric current flowing in the auxiliary anode 80 is kept zero. This is because the dimensions of the center opening 76 in the intermediate mask 70 of the embodiment are optimized according to the large terminal effect. In the case where the split anode is employed instead of the variable anode mask 62, the control is made to select an anode piece (anode pieces) which the electric current is to flow in or to regulate the electric current flowing in each of the anode pieces, corresponding to the electric field in such a state that the dimensions of the opening 62A of the variable anode mask 62 are the second dimensions (smaller than the first dimensions), so as to reduce the effective area of the anode or to reduce the expansion of the electric field (electric current) from the anode toward the substrate.

As shown in the second row in the table of FIG. 6, in the case of a medium level of terminal effect, prior to the regulations of the variable anode mask and the auxiliary anode, the plating film thickness in the edge portion of the substrate is made smaller than the plating film thickness in the center portion of the substrate. This is because the dimensions of the center opening 76 in the intermediate mask 70 of the embodiment are optimized according to the large terminal effect. More specifically, this is because the electric current flowing in the center portion of the substrate in the case of the medium level of terminal effect is larger than the electric current in the case of the large terminal effect to exceed the plating current flowing in the edge portion of the substrate, in the configuration prior to the regulations. In this state, a middle level of electric current (first electric current) is made to flow in the auxiliary anode 80 according to the magnitude of the terminal effect. This causes an electric field (electric current) to be supplied from the auxiliary anode 80 to the edge portion of the substrate and increases the plating film thickness in the edge portion of the substrate. This accordingly uniformizes the plating film thickness as shown by a solid line curve in the graph of an "auxiliary anode current optimization" cell in the second row of the table of FIG. 6. In this state, the dimensions of the opening of the variable anode mask 62 may be kept to the intermediate dimensions. In the case where the split anode is employed instead of the variable anode mask 62, the selection of an anode piece (anode pieces) which the electric current is to flow in or the regulation of the electric current flowing in each of the anode pieces may be identical with those prior to the regulations.

As shown in the third row in the table of FIG. 6, in the case of a small terminal effect, prior to the regulations of the variable anode mask and the auxiliary anode, the plating film thickness in the edge portion of the substrate is furthermore made smaller than the plating film thickness in the center portion of the substrate. As shown in FIG. 5, in this state, the dimensions of the opening 62A of the variable anode mask 62 are regulated according to the magnitude of the terminal effect to be dimensions (third dimensions) that are larger than the intermediate dimensions (first dimensions). As shown by a solid line curve in the graph of the "VAM opening optimization" cell in the third row of the table of FIG. 6, this reduces a difference between the electric field (electric current) reaching the center portion of the substrate and the electric field (electric current) reaching the edge portion of the substrate and thereby reduces a difference between the plating film thickness in the center portion of the substrate and the plating film thickness in the edge portion of the substrate. Furthermore, second electric current that is larger than the first electric current is made to flow in the auxiliary anode 80 according to the magnitude of the terminal effect. This increases the electric field (electric current) supplied from the auxiliary anode 80 to the edge portion of the substrate as shown in FIG. 5. This uniformizes the plating film thickness distribution as shown by a solid line curve in the graph of the "auxiliary anode current optimization" cell in the third row of the table of FIG. 6. In the case where the split anode is employed instead of the variable anode mask 62, the control is made to select an anode piece (anode pieces) which the electric current is to flow in or to regulate the electric current flowing in each of the anode pieces, corresponding to the electric field in such a state that the dimensions of the opening 62A of the variable anode mask 62 are the third dimensions (larger than the first dimensions), so as to increase the effective area of the anode or to increase the expansion of the electric field (electric current) from the anode toward the substrate.

As described above, the configuration of the embodiment uniformizes the plating film thickness distribution by regulating the dimensions of the opening 62A of the variable anode mask 62 and regulating the magnitude of the electric current flowing in the auxiliary anode 80 according to the magnitude of the terminal effect. More specifically, the plating film thickness distribution is uniformized by the regulations of making smaller the dimensions of the opening 62A of the variable anode mask 62 and making smaller the electric current flowing in the auxiliary anode 80 with an increase in the magnitude of the terminal effect and of making larger the dimensions of the opening 62A of the variable anode mask 62 and making larger the electric current flowing in the auxiliary anode 80 with a decrease in the magnitude of the terminal effect.

The regulation of the opening of the VAM and the regulation of the electric current flowing in the auxiliary anode may be performed according to the magnitude of the terminal effect, prior to plating of the substrate. Moreover, the regulation of the opening of the variable anode mask and the regulation of the electric current flowing in the auxiliary anode may be performed during plating of the substrate, in response to a change in the magnitude of the terminal effect with the growth of the plating film thickness.

As shown in FIG. 4 and FIG. 5, the configuration of the embodiment described above regulates the electric current that is to be supplied to the auxiliary anode 80 to have similar effects to those by regulating the dimensions of the center opening 76 of the intermediate mask 70 (i.e., regulates the substantial dimensions of the opening (effective opening area) of the intermediate mask). This configuration accordingly allows for the regulation according to the specification of the substrate (the resist opening ratio and the seed film thickness) to uniformize the plating film thickness distribution without requiring any mechanical mechanism for regulating the dimensions of the opening of the intermediate mask. The intermediate mask 70 is placed at a position near to the substrate W and the paddle 90. There is accordingly only a limited space for placing a mechanical mechanism for regulating the dimensions of the opening of the intermediate mask 70. The configuration of the embodiment, however, uses the auxiliary anode 80, as an electric field regulating device placeable in a narrow space, to electrically regulate the substantial dimensions of the opening of the intermediate mask 70. Especially a plating apparatus for rectangular substrates having large dimensions has high technical hurdles, since the mechanical mechanism is required to have high dimensional accuracy and high precision. The configuration of the embodiment, however, does not require such a mechanical mechanism and enables the electric field regulating device to be placed in the narrow space.

Furthermore, the configuration of the embodiment described above facilitates the maintenance of the intermediate mask 70 and management of the liquid inside of the intermediate mask 70. The configuration of using an auxiliary cathode, it is required to isolate the auxiliary cathode by an ion exchange membrane and to fill the auxiliary cathode with a plating metal-free electrolytic solution that is different from the plating solution for the purpose of preventing plating deposition onto the auxiliary cathode. This complicates the liquid management and the structure. The configuration of the embodiment, on the other hand, uses the auxiliary anode. This configuration does not cause plating deposition onto the auxiliary anode and thereby facilitates the liquid management. In the case where the insoluble anode is used for the auxiliary anode, this does not cause consumption of the auxiliary anode and facilitates the maintenance.

Additionally, the configuration of the embodiment described above has the auxiliary anode provided in the intermediate mask. This configuration is more unlikely to have dimensional limitation, compared with the configuration that the electrode is placed between the substrate and the paddle. Moreover, the configuration of placing the auxiliary anode inside of the intermediate mask does not need to separately provide a structure of supporting the auxiliary anode and thereby suppresses the complication of the structure.

Second Embodiment

Figure 7:
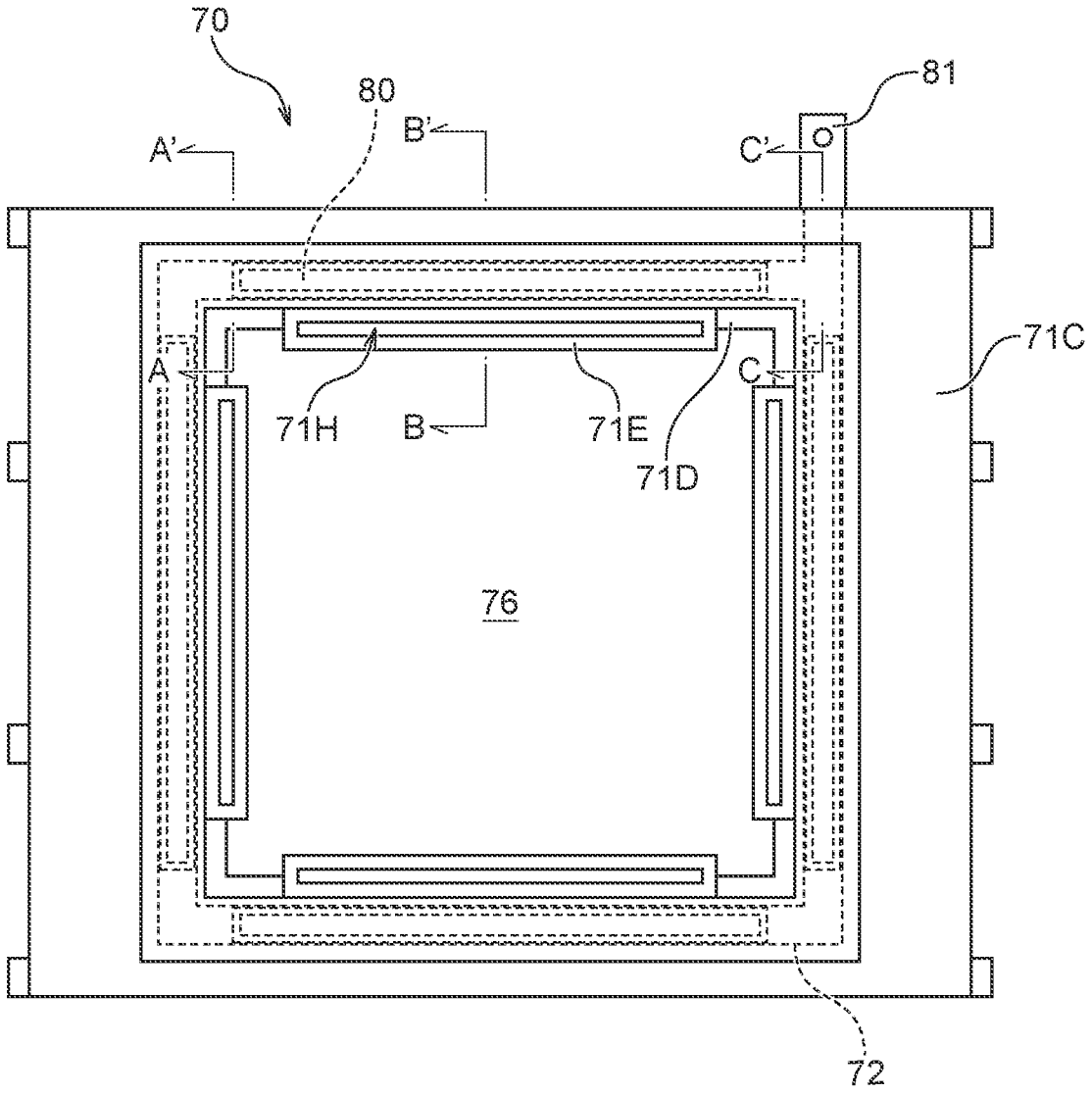
FIG. 7 is a schematic diagram illustrating an intermediate mask according to a second embodiment viewed from the substrate side.
Figure 8:
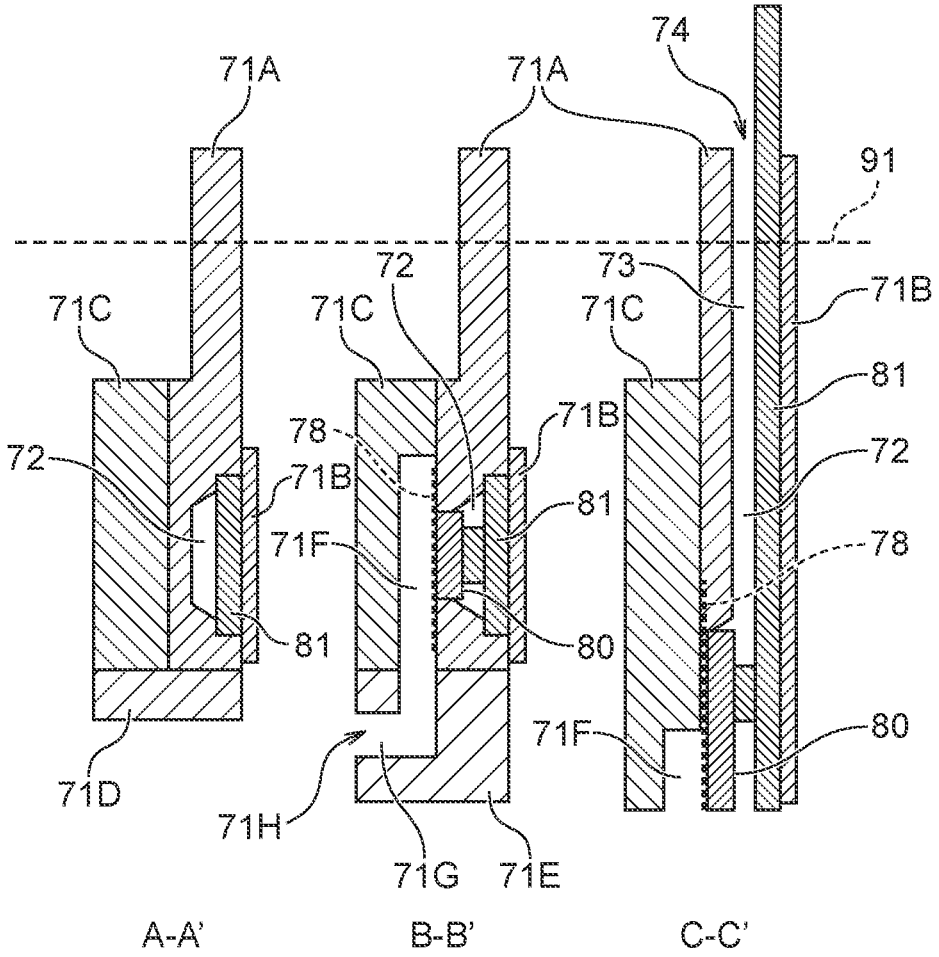
FIG. 8 is sectional views illustrating respective parts of the intermediate mask according to the second embodiment.

FIG. 7 is a schematic diagram illustrating an intermediate mask according to a second embodiment viewed from the substrate side. FIG. 8 is sectional views illustrating respective parts of the intermediate mask according to the second embodiment. The sectional views of FIG. 8 are respectively sectional view taken on a line A-A', taken on a line B-B' and taken on a line C-C' in FIG. 7. In the description below, like components to those of the above embodiment are expressed by like reference signs with omission of detailed description thereof. The following mainly describes differences from the above embodiment.

As shown in FIG. 7, in an intermediate mask 70 of this embodiment, in the front view, an outlet port 71H of the electric field (electric current) from auxiliary anode 80 is not provided at a position overlapping with the auxiliary anode 80 but is provided at a position different from the position of the auxiliary anode 80 (at a position on the more inner side of the intermediate mask). The intermediate mask 70 includes a base panel 71A and a back cover 71B constituting a mask main body, a front cover 71C, a center block 71E and a corner block 71D. The corner block 71D is provided to regulate the opening size and the opening shape at a corner portion of a mask center opening 76 but may be omitted. All of or part of the base panel 71A, the back cover 71B, the front cover 71C, the center block 71E and the corner block 71D may be formed integrally. All of or part of the base panel 71A, the front cover 71C and the center block 71E may be formed integrally. For example, the base panel 71A and the front cover 71C may be formed integrally. The front cover 71C and the center block 71E may be formed integrally. The base panel 71A, the front cover 71C and the center block 71E may be formed integrally.

As shown in FIG. 8, an internal space 72 is provided between the base panel 71A and the back cover 71B, and the auxiliary anode 80 is placed in the internal space 72. The auxiliary anode 80 is electrically connected with a bus bar 81 in the internal space 72, and electric current is supplied from a power source (not shown) via the bus bar 81 to the auxiliary anode 80. An exhaust passage 73 connecting with the internal space 72 is provided between the base panel 71A and the back cover 71B, and an upper end of the exhaust passage 73 forms an exhaust port 74 that is open above a liquid level 91 of the plating solution. The base panel 71A has an opening on a front face thereof which the auxiliary anode 80 is exposed on and which is covered with a diaphragm 78.

The front cover 71C is attached to the front face of the base panel 71A. As shown by the B-B' sectional view of FIG. 8, the front cover 71C is provided with a passage 71F that communicates with the opening of the base panel 71A which the auxiliary anode 80 is exposed on. The base panel 71A and the front cover 71C have center openings corresponding to the center opening 76 of the intermediate mask 70 (shown in FIG. 7). In these center openings, the corner block 71D and the center block 71E are attached to the base panel 71A and the front cover 71C. The corner block 71D and the center block 71E may be fixed to each other. The center opening 76 of the intermediate mask 70 is defined inside of the corner block 71D and the center block 71E. The center block 71E is provided with a passage 71G that communicates with the passage 71F of the front cover 71E, and an edge of the passage 71G forms the outlet port 71H. Accordingly, the electric field (electric current) from the auxiliary anode 80 is supplied through the passage 71F of the front cover 71C and the passage 71G and the outlet port 71H of the center block 71E to the substrate W.

This embodiment has functions and advantageous effects described below, in addition to similar functions and advantageous effects to those of the first embodiment. The configuration of the embodiment regulates the opening position and/or the opening dimensions of the outlet port 71H of the center block 71, so as to adjust a controllable range by the auxiliary anode 80. Furthermore, in the case of plating the substrates having the small terminal effect, the configuration of the embodiment sets the extracting position of the electric field (electric current) (the outlet port 71H) according to a specific area where the film thickness is specifically lowered (this varies, depending on the specification of the substrate and the power feeding method). This effectively increases the thickness of the film in this area by the electric current from the auxiliary anode and furthermore uniformizes the plating film thickness distribution of the entire substrate.

Other Embodiments (1) The above embodiments illustrate the case of plating the substrate in a rectangular shape. The configurations of the above embodiments may also be applicable to the case of plating a substrate in a circular shape (for example, a wafer).

(2) The above embodiments illustrate the case of using an insoluble anode as the auxiliary anode. A soluble anode may, however, be used for the auxiliary anode. In this case, the diaphragm provided to isolate the auxiliary anode and the exhaust passage provided to discharge oxygen generated in the auxiliary anode may be omitted.

(3) The above embodiments illustrate the dip-type plating apparatus configured to soak the substrate in a vertical direction in the plating solution. The configurations of the above embodiments may also be applicable to a face down-type (cupt-type) plating module where the anode and the substrate are arranged to be extended in the horizontal direction.

The present disclosure may also be implemented as aspects given below.

According to aspect 1, there is provided an apparatus for plating a substrate, comprising: an anode placed to be opposed to the substrate; and an intermediate mask placed between the substrate and the anode to be arranged on a substrate side, provided with a first center opening that causes an electric field from the anode toward the substrate to pass through, and further provided with an auxiliary anode that is placed in an internal space of the intermediate mask to be arranged around the first center opening, wherein the auxiliary anode has an area that is not greater than ⅕ of an area of the anode. The intermediate mask is also called a tunnel regulation plate (TRP) and is a mask serving to regulate passage of the electric field (electric current) from the anode toward the substrate in the vicinity of the substrate. Unlike an ionic current collimator placed on an anode side, the intermediate mask is placed between the substrate and the anode to be arranged on a substrate side, in other words, at a position near to or near the substrate.

The configuration of this aspect regulates the electric current that is to be supplied to the auxiliary anode placed in the intermediate mask to have similar effects to those by changing the dimensions of the opening of the intermediate mask. This configuration accordingly reduces the influence of the terminal effect caused by the specification of the substrate (the resist opening ratio and the seed film thickness) and allows for the regulation to uniformize the plating film thickness distribution without requiring any mechanical mechanism for regulating the dimensions of the opening of the intermediate mask. The intermediate mask is placed at a position near to the substrate (and a paddle). There is accordingly only a limited space for placing a mechanical mechanism for regulating the dimensions of the opening of the intermediate mask. The configuration of this aspect, however, uses the auxiliary anode, as an electric field regulating device placeable in a narrow space, to electrically regulate the substantial dimensions of the opening of the intermediate mask. The dimensions of the opening of the intermediate mask that take into account the effect of the electric field (electric current) that is to be supplied from the auxiliary anode to the substrate is referred to as the substantial dimensions of the opening (effective opening dimensions). In one example, the dimensions of the first center opening of the intermediate mask are narrowed (to the small dimensions) according to the large terminal effect. Regulating the electric current that is to be supplied to the auxiliary anode according to the magnitude of the terminal effect (the resist opening ratio and the seed film thickness) of the substrate has equivalent effects to those by changing the dimensions of the opening of the intermediate mask to uniformize the film thickness at an edge portion of the substrate.

Furthermore, the auxiliary anode is provided in the intermediate mask that is placed near to the substrate. The auxiliary anode of the small area (of the area that is not greater than ⅕ of the area of the anode) effectively controls the electric field to the edge portion of the substrate and suppresses the influence of the terminal effect. Additionally, the configuration of placing the auxiliary anode at a position near to the edge portion of the substrate where the control of the electric field is required enables the electric field to the edge portion of the substrate to be effectively controlled by making a flow of the smaller electric current by the auxiliary anode of the smaller area, compared with a configuration of placing the auxiliary anode at a position farther from the edge portion of the substrate. Flowing the large electric current in the auxiliary anode of the small area has the following disadvantages. In the case of using a soluble auxiliary anode (phosphorus-containing copper), formation of a black film on the surface of the auxiliary anode becomes unstable. This increases generation of sludge and anode slime from the auxiliary anode and is likely to adversely affect the quality of the plating film. In the case of using an insoluble anode, the potential of the electrode is likely to become excessive high in the plating process. This is likely to cause a side reaction, for example, oxidation of Cl-ion included in the plating solution.

According to aspect 2, there is provided an apparatus for plating a substrate, comprising: an anode placed to be opposed to the substrate; and an intermediate mask placed between the substrate and the anode, provided with a first center opening that causes an electric field from the anode toward the substrate to pass through, and further provided with an auxiliary anode that is placed in an internal space of the intermediate mask to be arranged around the first center opening, wherein the intermediate mask further includes an air vent hole that communicates with the internal space and that is open above a liquid level of a plating solution.

The configuration of this aspect enables a gas generated in the internal space of the intermediate mask to be discharged to outside. For example, in the case of an insoluble auxiliary anode, this configuration enables oxygen generated by an electrode reaction at the auxiliary anode to be discharged from the internal space of the intermediate mask to outside of the intermediate mask. This prevents or suppresses bubbles from being accumulated around the auxiliary anode and interfering with the electric field (electric current) from the auxiliary anode toward the substrate.

According to aspect 3, in the apparatus for plating described in either the aspect 1 or the aspect 2, a distance between the intermediate mask and the substrate may be not less than ¼ and not greater than ⅓ of a distance between the anode and the substrate.

The configuration of this aspect enables the auxiliary anode provided in the intermediate mask to be placed sufficiently near to the edge portion of the substrate. This configuration enables the electric field (electric current) from the auxiliary anode toward the edge portion of the substrate to be efficiently controlled. This accordingly enables the terminal effect to be efficiently controlled.

According to aspect 4, in the apparatus for plating described in any one of the aspect 1 to the aspect 3, the intermediate mask may comprise a mask main body provided with a second center opening and further provided with the internal space that is arranged around the second center opening and that is open on a substrate side thereof; and a shielding plate placed to cover the internal space of the mask main body, provided with a third center opening that is smaller than the second center opening and that defines the first center opening, and further provided with a first opening that overlaps with at least a partial area of the auxiliary anode.

The configuration of this aspect enables the electric field (electric current) from the anode toward the substrate to be adjusted by regulating the size of the third center opening of the shielding plate. This configuration also enables the intensity of the electric field from the auxiliary anode toward the substrate to be adjusted by regulating the size of the first opening of the shielding plate.

According to aspect 5, in the apparatus for plating described in the aspect 4, the shielding plate may further include a diaphragm provided to cover the first opening.

In the case of an insoluble auxiliary anode, when an additive component included in the plating solution is oxidized by an electrochemical reaction on the surface of the insoluble auxiliary anode to generate a harmful decomposition product that is harmful to the plating performance, the configuration of this aspect suppresses the harmful decomposition product from reaching the surface of the substrate and thereby maintains the plating performance.

According to aspect 6, in the apparatus for plating described in any one of the aspect 1 to the aspect 3, the intermediate mask may include a passage that causes an electric field from the auxiliary anode toward the substrate to pass through and that has an outlet provided at a position which does not overlap with the auxiliary anode in a plane parallel to the substrate. For example, the outlet of the passage may be provided inside of the auxiliary anode in the plane parallel to the substrate.

In the case of plating the substrate having a small terminal effect, the configuration of this aspect sets the outlet of the passage that is an extracting position of the electric field (electric current) from the intermediate mask according to a specific area where the plating film thickness is specifically lowered (this varies, depending on the specification of the substrate and the power feeding method). This effectively increases the thickness of the plating film in this specific area by the electric current from the auxiliary anode and furthermore uniformizes the plating film thickness distribution.

According to aspect 7, in the apparatus for plating described in the aspect 6, the intermediate mask may comprise a mask main body: a cover mounted to cover a substrate side of the mask main body and configured to form, along with the mask main body, a fourth center opening corresponding to the first center opening; and a block mounted to the mask main body and the cover on a periphery of the fourth center opening. The mask main body may include the internal space and may have a second opening that overlaps with at least a partial area of the auxiliary anode. The cover may include a first passage that communicates with the second opening. The block may include a second passage that communicates with the first passage. The first passage and the second passage may form the passage that causes the electric field from the auxiliary anode toward the substrate to pass through.

The configuration of this aspect enables the passage where the electric field (electric current) passes through from the auxiliary anode to the outlet that is away from the auxiliary anode, to be formed by the simple structure of the mask main body, the cover and the block.

According to aspect 8, in the apparatus for plating described in the aspect 7, the mask main body may be further provided with a diaphragm to cover the second opening.

The configuration of this aspect enables the internal space where the auxiliary anode is placed to be isolated by the diaphragm. When an additive component included in the plating solution is oxidized by an electrochemical reaction on the surface of the insoluble auxiliary anode to generate a harmful decomposition product that is harmful to the plating performance, the configuration of this aspect suppresses the harmful decomposition product from reaching the surface of the substrate by the diaphragm and thereby maintains the plating performance.

According to aspect 9, in the apparatus for plating described in any one of the aspect 1 to the aspect 8, the substrate may be in a rectangular shape. The first center opening of the intermediate mask may have a shape corresponding to the shape of the substrate. The auxiliary anode may be placed along four sides of the first center opening.

The configuration of this aspect has the functions and the advantageous effects described above with regard to the rectangular substrate. In an apparatus for plating the rectangular substrates, it is difficult to mount a mechanical mechanism for regulating the dimensions of the opening of the mask, since the dimensions of the rectangular substrate are larger than those of a wafer. Furthermore, since the intermediate mask is placed at a position near to the substrate, a change in the dimensions of the opening significantly affects the plating film thickness. The mechanical mechanism is thus required to have high dimensional accuracy and to have high precision. In the apparatus for plating the rectangular substrates having large dimensions, the configuration of this aspect does not require such a mechanical mechanism having high technical hurdles but has similar effects to those by controlling the electric current flowing in the auxiliary anode to change the dimensions of the opening of the intermediate mask.

According to aspect 10, in the apparatus for plating described in the aspect 9, the auxiliary anode may be divided into a plurality of auxiliary anodes, and the auxiliary anodes may be arranged along respective sides of the first opening at positions other than corners of the first opening.

The configuration of this aspect suppresses an increase in the film thickness at corners of the rectangular substrate, in the case where the electric field is concentrated at the corners to increase the film thickness.

According to aspect 11, the apparatus for plating described in any of the aspect 1 to the aspect 10 may further comprise a variable anode mask configured to regulate an exposed area of the anode.

The configuration of this aspect enables the exposed area of the anode (the effective area that provides the electric field toward the substrate) to be adjusted by the variable anode mask according to the magnitude of the terminal effect. This accordingly enables the magnitude of the plating current flowing in the respective parts of the substrate to be regulated by a combination of controlling the electric current flowing in the auxiliary anode of the intermediate mask and controlling the electric field from the anode toward the substrate according to the magnitude of the terminal effect and thereby uniformizes the plating film thickness.

According to aspect 12, in the apparatus for plating described in any of the aspect 1 to the aspect 10, the anode may be a split anode consisting of a plurality of anode pieces. An effective area of the anode that provides the electric field toward the substrate may be adjusted by selecting an anode piece which electric current is to flow in, or the electric field from the anode toward the substrate may be adjusted by regulating electric current flowing in each of the anode pieces.

The configuration of this aspect enables the electric field from the anode toward the substrate to be controlled electrically according to the magnitude of the terminal effect. This accordingly enables the magnitude of the plating current flowing in the respective parts of the substrate to be regulated by a combination of controlling the electric current flowing in the auxiliary anode of the intermediate mask and controlling the electric field from the anode toward the substrate according to the magnitude of the terminal effect and thereby uniformizes the plating film thickness.

According to aspect 13, there is provided a method of plating a substrate, comprising: providing an intermediate mask that is placed between the substrate and an anode, wherein the intermediate mask comprises a center opening configured to control an electric field from the anode toward the substrate; and an auxiliary anode that is placed around the center opening and that has an area of not greater than ⅕ of an area of the anode; and regulating expansion of the electric field from the anode toward the substrate and regulating electric current that is to be supplied to the auxiliary anode placed in the intermediate mask, according to a resist opening ratio and a magnitude of seed resistance of the substrate.

According to aspect 14, in the method described in the aspect 13, the expansion of the electric field from the anode toward the substrate may be adjusted by a variable anode mask that is configured to regulate an exposed area of the anode.

According to aspect 15, in the method described in the aspect 13, the anode may be a split anode consisting of a plurality of anode pieces, wherein the expansion of the electric field from the anode toward the substrate may be adjusted by selecting an anode piece which electric current is to flow in, or by regulating electric current flowing in each of the anode pieces.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit the embodiments and the modifications described above and it is also possible to arbitrarily combine or omit respective constituent elements described in the claims and the specification in a range where at least a part of the above-mentioned problem can be solved or a range where at least a part of the effect is exhibited.

REFERENCE SIGNS LIST

11 substrate holder
38 overflow tank
39 plating tank (plating cell)
40 plating module
60 anode
61 anode holder
62 anode mask
62A opening
63 anode box
64 diaphragm
70 intermediate mask
71 mask main body
71A base panel
71B back cover
71C front cover
71D corner block
71E center block
71F passage
71G passage
71H outlet port
72 internal space
73 exhaust passage
74 exhaust port
75 shielding plate
76 center opening
77 opening
78 diaphragm
80 auxiliary anode
81 bus bar
90 paddle
91 liquid level

The invention claimed is:

1. An apparatus for plating a substrate, comprising:
an anode placed to be opposed to the substrate; and
an intermediate mask placed between the substrate and the anode to be arranged on a substrate side, provided with a first center opening that causes an electric field from the anode toward the substrate to pass through, and further provided with an auxiliary anode that is placed in an internal space of the intermediate mask to be arranged around the first center opening, wherein
the auxiliary anode has an area that is not greater than ⅕ of an area of the anode, wherein the intermediate mask comprises:
a mask main body provided with a second center opening and further provided with the internal space that is arranged around the second center opening and that is open on a substrate side thereof; and
a shielding plate placed to cover the internal space of the mask main body, provided with a third center opening that is smaller than the second center opening and that defines the first center opening, and further provided with a first opening that overlaps with at least a partial area of the auxiliary anode.

2. The apparatus for plating a substrate according to claim 1, wherein the intermediate mask further includes an air vent hole that communicates with the internal space and that is open above a liquid level of a plating solution.

3. The apparatus for plating according to claim 1, wherein a distance between the intermediate mask and the substrate is not less than ¼ and not greater than ⅓ of a distance between the anode and the substrate.

4. The apparatus for plating according to claim 1, wherein the shielding plate further includes a diaphragm provided to cover the first opening.

5. The apparatus for plating according to claim 1, wherein the substrate is in a rectangular shape, the first center opening of the intermediate mask has a shape corresponding to the shape of the substrate, and the auxiliary anode is placed along four sides of the first center opening.

6. The apparatus for plating according to claim 5, wherein the auxiliary anode is divided into a plurality of auxiliary anodes, and the auxiliary anodes are arranged along respective sides of the first center opening at positions other than corners of the first center opening.

7. The apparatus for plating according to claim 1, further comprising:

a variable anode mask configured to regulate an exposed area of the anode.

8. The apparatus for plating according to claim 1, wherein the anode is a split anode consisting of a plurality of anode pieces, wherein an effective area of the anode that provides the electric field toward the substrate is adjusted by selecting an anode piece which electric current is to flow in, or the electric field from the anode toward the substrate is adjusted by regulating electric current flowing in each of the anode pieces.

9. The apparatus for plating a substrate, comprising:

an anode placed to be opposed to the substrate; and an intermediate mask placed between the substrate and the anode to be arranged on a substrate side, provided with a first center opening that causes an electric field from the anode toward the substrate to pass through, and further provided with an auxiliary anode that is placed in an internal space of the intermediate mask to be arranged around the first center opening, wherein the auxiliary anode has an area that is not greater than ⅕ of an area of the anode, and wherein the intermediate mask includes a passage that causes an electric field from the auxiliary anode toward the substrate to pass through and that has an outlet provided at a position which does not overlap with the auxiliary anode in a plane parallel to the substrate.

10. The apparatus for plating according to claim 9, wherein the intermediate mask comprises:

a mask main body;

a cover mounted to cover a substrate side of the mask main body and configured to form, along with the mask main body, a fourth center opening corresponding to the first center opening; and a block mounted to the mask main body and the cover on a periphery of the fourth center opening, wherein the mask main body includes the internal space and has a second opening that overlaps with at least a partial area of the auxiliary anode, the cover includes a first passage that communicates with the second opening, and the block includes a second passage that communicates with the first passage, wherein the first passage and the second passage form the passage that causes the electric field from the auxiliary anode toward the substrate to pass through.

11. The apparatus for plating according to claim 10, wherein the mask main body is further provided with a diaphragm to cover the second opening.

12. A method of plating a substrate, comprising:

providing an intermediate mask that is placed between the substrate and an anode to be arranged on a substrate side, wherein the intermediate mask comprises a first center opening configured to control an electric field from the anode toward the substrate; and an auxiliary anode that is placed in an internal space of the intermediate mask to be arranged around the center opening wherein the auxiliary anode has an area of not greater than ⅕ of an area of the anode, the intermediate mask comprising a mask main body provided with a second center opening and further provided with the internal space that is arranged around the second center opening and that is open on a substrate side thereof; and a shielding plate placed to cover the internal space of the mask main body, provided with a third center opening that is smaller than the second center opening and that defines the first center opening, and further provided with a first opening that overlaps with at least a partial area of the auxiliary anode; and regulating expansion of the electric field from the anode toward the substrate and regulating electric current that is to be supplied to the auxiliary anode placed in the intermediate mask, according to a resist opening ratio and a magnitude of seed resistance of the substrate.

13. The method according to claim 12, wherein the expansion of the electric field from the anode toward the substrate is adjusted by a variable anode mask that is configured to regulate an exposed area of the anode.

14. The method according to claim 12, wherein the anode is a split anode consisting of a plurality of anode pieces, wherein the expansion of the electric field from the anode toward the substrate is adjusted by selecting an anode piece which electric current is to flow in or by regulating electric current flowing in each of the anode pieces.

* * * * *